US010690460B2

(12) United States Patent
Tian

(10) Patent No.: US 10,690,460 B2
(45) Date of Patent: Jun. 23, 2020

(54) ARROW DEVICE WITH DUAL DESTRUCTIVE FUNCTION

(71) Applicant: Yuefeng Tian, Tangshan (CN)

(72) Inventor: Yuefeng Tian, Tangshan (CN)

(73) Assignee: Yuefeng Tian, Tangshan (CN)

( * ) Notice: Subject to any disclaimer, the term of this patent is extended or adjusted under 35 U.S.C. 154(b) by 0 days.

(21) Appl. No.: 16/075,047

(22) PCT Filed: Apr. 14, 2016

(86) PCT No.: PCT/CN2016/000196
§ 371 (c)(1),
(2) Date: Aug. 2, 2018

(87) PCT Pub. No.: WO2017/132782
PCT Pub. Date: Aug. 10, 2017

(65) Prior Publication Data

US 2019/0041174 A1 Feb. 7, 2019

(30) Foreign Application Priority Data

Feb. 5, 2016 (CN) ..... 2016 1 0090893

(51) Int. Cl.
*F42B 6/08* (2006.01)
*F42B 6/04* (2006.01)
(Continued)

(52) U.S. Cl.
CPC ..... *F42B 6/08* (2013.01); *F42B 6/04* (2013.01); *F42B 12/54* (2013.01); *F42B 12/625* (2013.01)

(58) Field of Classification Search
CPC ..... F42B 6/04; F42B 6/08
See application file for complete search history.

(56) References Cited

U.S. PATENT DOCUMENTS 3,580,172 A * 5/1971 Hendricks ..... A01K 81/04 102/371
4,729,320 A * 3/1988 Whitten, III ..... F42B 12/362 102/371

(Continued)

FOREIGN PATENT DOCUMENTS

| | | |
|---|---|---|
| CN | 202533008 U | 11/2012 |
| CN | 205373548 U | 7/2016 |
| JP | H10165077 A | 6/1998 |

OTHER PUBLICATIONS

International Search Report and Written Opinion as issued in connection with International Patent Application No. PCT/CN2016/000196, dated Oct. 28, 2016.

*Primary Examiner* — John A Ricci
(74) *Attorney, Agent, or Firm* — Maschoff Brennan

(57) ABSTRACT

The present invention relates to an arrow device with dual destructive function which provides a second extended destruction by explosion of explosives carried within the arrow device in addition to a penetrative destruction caused by kinetic energy of an arrow. The arrow device with dual destructive function comprises an arrow body and an arrowhead, wherein the arrow body comprises a hollow tube, the hollow tube is provided with an inertial body therein, the arrowhead is of a hollow structure and is provided with a hole structure communicating the hollow structure of the arrowhead with the outside. The hollow structure of the arrowhead is equipped with explosives or ammunition therein. An isolation mechanism is provided between the arrowhead and the hollow tube of the arrow body. A firing mechanism for firing explosives or ammunition is provided on the isolation mechanism or the front end of the inertia body.

17 Claims, 7 Drawing Sheets

(51) Int. Cl.
*F42B 12/54* (2006.01)
*F42B 12/62* (2006.01)

(56) References Cited

U.S. PATENT DOCUMENTS

| | | | | |
|---|---|---|---|---|
| 4,762,328 | A * | 8/1988 | Beyl | F42B 6/08 102/507 |
| 6,311,623 | B1 * | 11/2001 | Zaruba | F42B 6/04 102/371 |
| 8,241,157 | B2 * | 8/2012 | Russell | F42B 6/04 473/578 |
| 9,297,624 | B2 * | 3/2016 | Pierce | A61L 9/12 |
| 2010/0197430 | A1 * | 8/2010 | Martin | F41J 3/0004 473/577 |
| 2013/0123051 | A1 | 5/2013 | Pierce et al. | |
| 2014/0296007 | A1 | 10/2014 | Pierce et al. | |

* cited by examiner

ARROW DEVICE WITH DUAL DESTRUCTIVE FUNCTION

TECHNICAL FIELD

The present invention relates to a field of a firing device. More specifically, the present invention relates to a field of bows, in particular, to an arrow device.

BACKGROUND ART

Kinetic energy weapons, such as bows and arrows and bolts, by using elastic potential energy principle of material and by combining an elastic force of human beings and an elastic force of objects, make arrow shoot distance, so as to achieve the purpose of target shooting. Conventional arrow includes a solid or hollow arrow shaft, a solid arrowhead attached to a front end of the arrow shaft, a nock attached to a rear end of the arrow shaft and a feather disposed at a rear portion of the arrow shaft.

However, the conventional arrows have less destruction to the target. In case of encountering wild boar, crocodiles and other animals which are athletic and have strong skin defense ability when hunting or in case of hunting for large animals, a conventional bow and arrow may be difficult to do the job. Thus, bows and arrows or bolts with overall and higher performance are necessary in the art.

SUMMARY OF THE INVENTION

The present invention is to provide a destructive device by making improvements to an arrowhead which is provided with explosives therein and setting an inertial body in a hollow tube of an arrow body, thereby creating a second destruction in addition to a penetrative destruction caused by kinetic energy which is generated at the time of explosion of explosives. The arrow device can greatly expand power of the weapons such as arrows destroying target with use of kinetic energy.

Thus, in a first aspect, the present invention provides an arrow device with dual destructive function, wherein the arrow device comprises an arrow body and an arrowhead, the arrow body comprises a hollow tube, the hollow tube is provided with an inertial body therein, the arrowhead is of a hollow structure and is provided with a hole structure communicating the hollow structure of the arrowhead with the outside, the hollow structure of the arrowhead is equipped with explosives or ammunition therein, and an isolation mechanism is provided between the arrowhead and the hollow tube of the arrow body, wherein a firing mechanism for firing explosives or ammunition is provided on the isolation mechanism or a front end of the inertia body. For example, the firing mechanism fires explosives by a primer or a fuse.

In one embodiment, the explosives are ammunition, such as blank ammunition or bullets. When the ammunition is bullet, the front end of the arrowhead may be provided with an opening for passage of a bullet.

In one embodiment, a firing mechanism for firing explosives or ammunition is provided front of the inertia body.

In a preferred embodiment, the firing mechanism on the isolation mechanism is a firing pin or a firing hammer.

In one embodiment, a firing portion of the firing mechanism is located between a center and a periphery of a cross-section of the arrow body, and a uniform force mechanism is provided between the inertial body and the firing mechanism.

In one embodiment, the firing portion of the firing mechanism is located at the center of the cross-section of the arrow body.

In one embodiment, the inertial body is spherical, conical, cylindrical or dumbbell-shaped.

In one embodiment, a plurality of holes are used for communicating the hollow structure of the arrowhead with the outside.

In one embodiment, the arrowhead is of a closed or substantially closed structure, said closed or substantially closed structure is broken away when the ammunition or explosives in the arrowhead explore.

In one embodiment, a housing of the arrowhead has a prefabricated scrap thereon.

In one embodiment, an object to be fired is provided at the arrowhead. The object to be fired may be a variety of substances and may have a variety of shapes. For example, the object to be fired may be round, square, cylindrical, conical, triangular, and so on. More preferably, in order to obtain more kinematic energy, the object to be fired may be designed with a hollow cavity at a bottom thereof so as to communicate with the outside at one end of the hollow cavity.

In one embodiment, the inertial body is weakly connected to a rear end of the hollow tube of the arrow body prior to firing and strikes forward along the hollow tube of the arrow body when a strike occurs so as to strike the ammunition or explosives.

In a more preferred embodiment, the rear end of the hollow tube of the arrow body is provided with an elastic mechanism which is weakly connected to the inertial body prior to firing.

The present invention seeks to protect any combination of the above embodiments, as long as the combined technical solutions comply with the principle of the invention.

In a second aspect, the present invention provides a bow and arrow or a bolt comprising the arrow device with dual destructive function of the present invention.

The present invention achieves firing kinetic energy of the internal inertial body by utilizing an inertia force arising from kinetic energy of the external arrow body so as to initiate ammunition. Compared with the conventional arrow device, with the same level of power, the present invention can significantly enhance the overall effectiveness of the arrow device and success chance of the hunting.

BRIEF DESCRIPTION OF THE DRAWINGS

FIG. 2 shows an embodiment in which the ammunition primer is located at a center when the firing is performed, wherein

FIG. 3 shows an embodiment in which the ammunition primer is located at an edge when the firing is performed, wherein

FIG. 4 shows the arrow device with dual destructive function in which the ammunition is blank ammunition, wherein

Figure 5A:
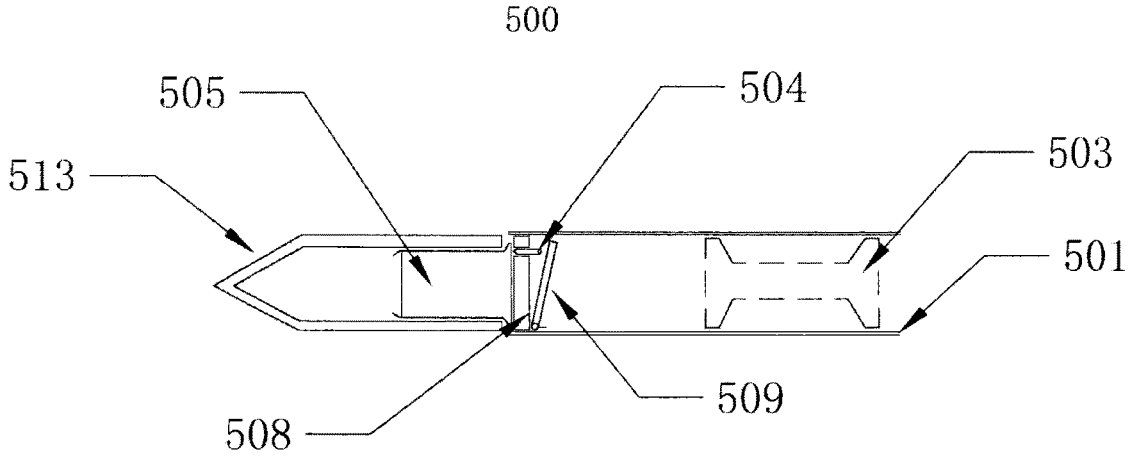
Figure 5B:
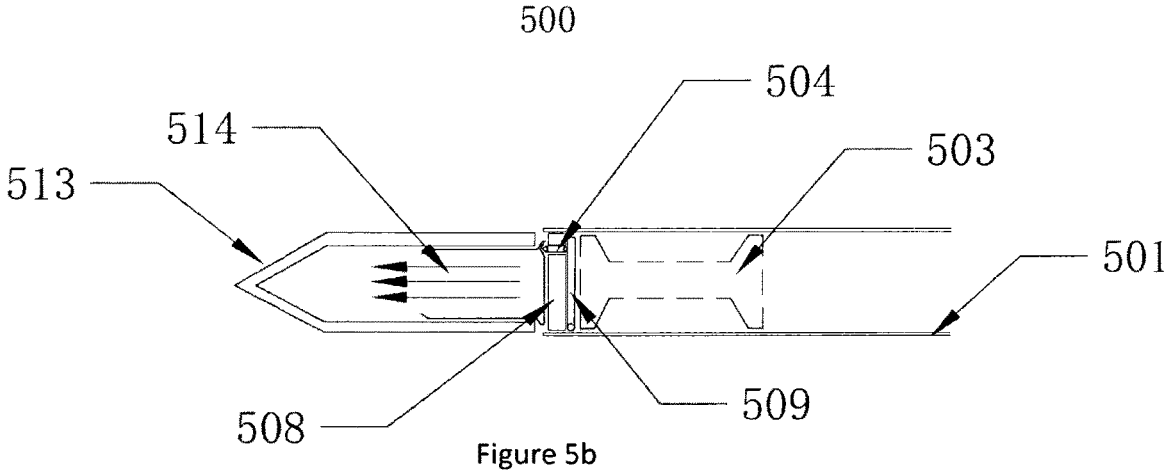
Figure 6A:
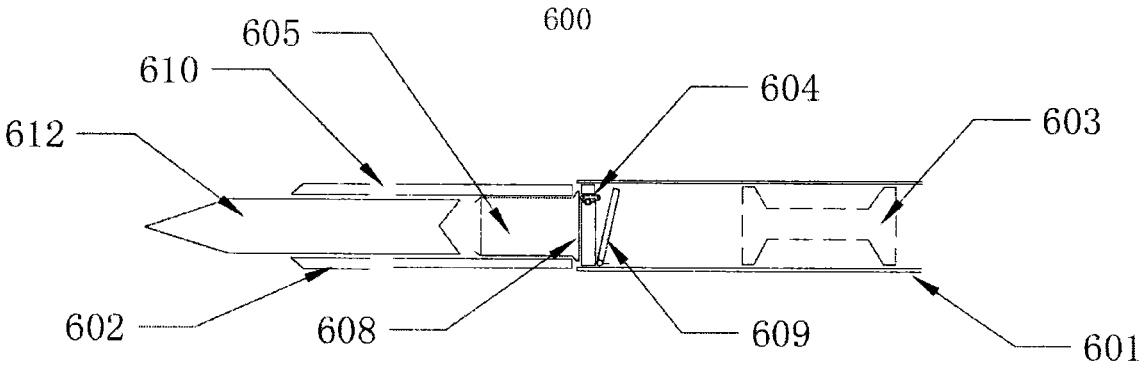
Figure 6B:
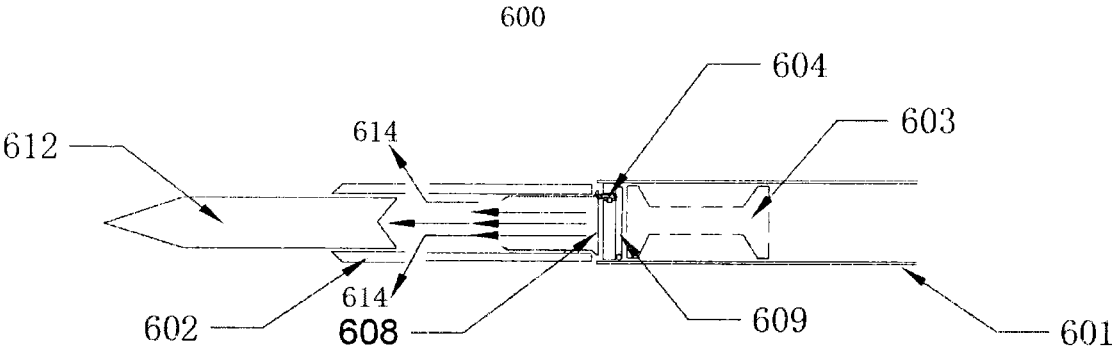
Figure 7:
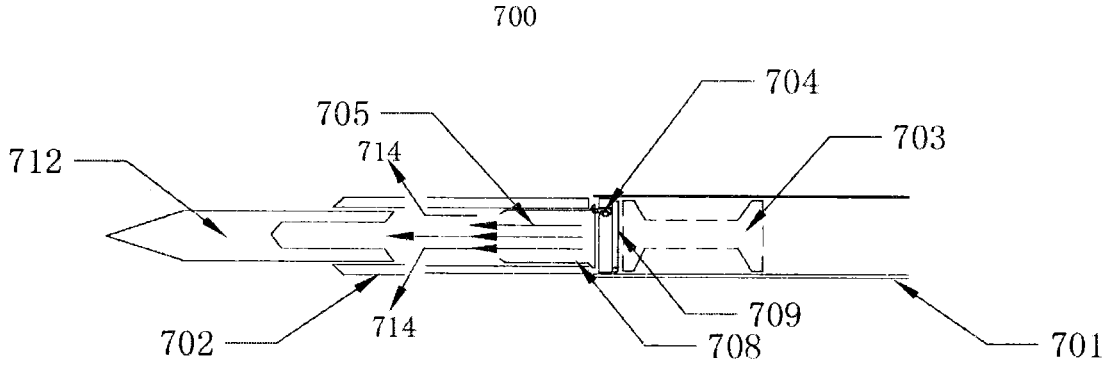

FIG. 5 shows the arrow device with dual destructive function in which the arrowhead comprises a closed housing, wherein FIG. 5*a* shows a state in which the arrow device with dual destructive function is to be initiated, and FIG. 5*b* shows a state in which the arrow device with dual destructive function has been initiated;

FIG. 6 shows an embodiment in which the object to be fired is provided at the arrowhead, wherein FIG. 6*a* shows a state in which the arrow device with dual destructive function is to be initiated, and FIG. 6*b* shows a state in which the arrow device with dual destructive function has been initiated; and FIG. 7 shows another embodiment in which the object to be fired is provided at the arrowhead.

Arrow body -101, 201, 301, 401, 501, 601, 701
Arrowhead -102, 402, 602, 702
Inertial body -103, 203, 303, 403, 503, 603, 703
Firing pin -104, 204, 304, 404, 504, 604, 704
Gunpowder -105, 205, 305, 405, 505, 605, 705
Nock -106
Limit mechanism -107
Primer -108, 208, 308, 408, 508, 608, 708
Uniform force mechanism -109, 209, 309, 409, 509, 609, 709
High temperature and pressure gas outlet -410, 610
Object to be fired -612, 712
Housing -513
High temperature and pressure gas -214, 314, 414, 514, 614, 714

DETAILED DESCRIPTION

An arrow device with dual destructive function of the present invention, as a firing device, can provide significant destruction. After the arrow device with dual destructive function is fired, when an arrowhead shoots a target and then significantly reduces its speed or becomes a stationary state from a high speed motion state, an inertial body continues "moving forward" due to an inertia force and hits a firing mechanism located at a front portion of an arrow body, such as a firing pin or firing hammer, such that the firing mechanism fires ammunition or explosives.

In the present invention, prior to firing, the inertial body may be weakly connected to a rear end of a hollow tube of the arrow body. When a strike occurs, such weak connection is broken and thus the inertial body moves forward along the hollow tube of the arrow body under inertia.

In the present invention, the inertial body means a mechanical member which controls sparkling depending on a contact with a target and has inertia. The firing mechanism is used to obtain energy and speed when being hit by the inertial body and fire the ammunition or explosives. Specifically, the firing mechanism is used to make an igniting case of a primer of a bullet deformed and presses gunpowder of the primer, such that gunpowder burns and ignites propellant or explosive to explode in the target, thereby causing second destruction.

In the present invention, the inertial body preferably is a mechanical member or members of composite material. In order to achieve different effects, the weight of the inertial body can be adjusted or set, and a distance between the inertial body and the firing mechanism in the arrow body is settable.

In the present invention, the inertial body may be spherical, conical, cylindrical, dumbbell-shaped or may have other regular or irregular shapes. Preferably, the inertial body takes a shape which brings reduced weight and increased kinetic energy and motion speed.

In the present invention, a position of the firing mechanism is consistent with that of the primers of the ammunition or a firing portion of a fuse.

In the present invention, a uniform force mechanism is provided between the inertial body and a firing pin. The uniform force mechanism has a suitable mechanical structure acting to transfer a force of the inertial body more efficiently to the firing mechanism. Accordingly, the weight of the inertial body may be further optimized. For example, the uniform force mechanism may be structured as a swingable rod or plate with one end thereof being limited. The inertial body strikes metal rods and the metal rods strike the firing pin.

In the present invention, the explosives are exploded within the arrowhead and thus the arrowhead may have the following structures:

(1) The arrowhead is provided with one or more holes communicating the inside of the arrowhead with the outside and acting as high temperature and pressure gas outlet(s). Explosive airflow will rush out from a void, and the rushed airflow will destroy the target. Holes disposed in different positions and different directions may guide the airflow so as to extend a range of the destruction. The void may be of various regular or irregular shapes, for example, may be circular, oval, rectangular, square, etc. Preferably, the void is elongate.

(2) The explosive airflow causes explosion of a housing of the arrowhead so as to damage the target. More preferably, the housing of the arrowhead may have a prefabricated scrap thereon. In this case, the scrap and airflow caused by explosion of the arrowhead will bring a tremendous destruction to the target.

If the explosive is gunpowder and is packed in the form of blank ammunition, it is preferable that the housing of the arrowhead is provided with one hole or a plurality of holes communicating the inside of the arrowhead with the outside. The hole is used to relieve pressure during a period of combustion after the ammunition is initiated so as to delay an explosion period of the housing of the arrowhead. In such way, a time period from a sufficient combustion of the ammunition to the explosion is extended. Accordingly, the energy is utilized and the dosage of the explosive is reduced to the most degree.

(3) An object to be fired may be provided at the arrowhead. The object to be fired may be a variety of substances and may have a variety of shapes. For example, the object to be fired may be round, square, cylindrical, conical, triangular, and so on. More preferably, in order to obtain more kinematic energy, the object to be fired may be designed with a hollow cavity at a bottom so as to communicate with the outside at one end of the hollow cavity. The housing of the arrowhead may be provided holes for guiding a portion of the gas generated from the explosives to other direction so as to extend a range of the destruction.

After initiation of the explosives, the explosives usually burn outwards from an initiation point. In such case, the explosives in an outer layer are often thrown off when they are not burnt completely. Thus, the explosives cannot burn completely so as to create an acting force. In the present invention, since the object to be fired has the hollow cavity at the bottom thereof, the following advantages will be obtained: the incompletely burnt explosives are pushed into the hollow cavity and continue to burn, explode and release energy.

The arrow containing the object to be fired according to the present invention may be used to break armor. Usually, animals having strong skin defense ability or bullet preventive materials or bullet resistant materials will distract the force of the arrow by their features when hit by the arrow. In such case, if the object to be fired is re-fired so as to destruct the animals having strong skin defense ability or bullet preventive materials or bullet resistant materials a second time, the effect of penetrating the animals having strong skin defense ability or bullet preventive materials or bullet resistant materials will be greatly enhanced.

The structures listed in items (1) and (2) are adopted in case of using blank ammunition.

The arrow device with dual destructive function according to the present invention has a uniform structure and thus applies a negligible impact to a flying path of the arrow.

The arrows are very sensitive to weight due to limited storage energy of bow. In the present invention, changes are made only to the arrowhead and the inertial body is provided in the hollow tube of the arrow body. Design of the present invention has little effect on the overall weight of the arrow. If the explosives are set on the arrow body, it is necessary to make special treatment to the location of the explosive, thereby necessarily increasing an additional structure and deadweight.

A testing results show that compared with the conventional arrow device, the arrow device in the present invention has substantially the same basic performances, such as weight thereof, a flying path and a penetrating power, and an additional and second destruction. Thus, the general property of the arrow device in the present invention is further optimized. In the present invention, the firing mechanism is provided on the isolation mechanism, the firing pin corresponds to the firing portion of the explosives in position, and the firing is achieved by means of strike of the inertial body. Thus, no too strict requirements are required for the shape and movement path of the inertial body. If the firing mechanism is disposed in a front end of the inertial body to achieve precise alignment of the firing portion of the explosives, too strict requirements are required for the shape and movement path of the inertial body. Accordingly, the firing mechanism is preferably provided on the isolation mechanism.

It is very important for the isolation mechanism to be provided between the arrowhead and the hollow tube of the arrow body so as to prevent an acting force generated from explosion of the arrowhead from transmitting to the arrow body, thereby losing no forward thrust and significantly reducing the impact force to the arrow body caused by explosion. More importantly, an area other than an arrow shoot area is a default safety area and damage will occur if the inertial body strikes the nock, but the isolation mechanism is provided to avoid a reverse rebound of the inertial body directly affected by an impact force of explosion. Thus, no threat will be made to the default safety area in the nock. Also, due to the isolation mechanism, the arrow body, the inertial body and the relevant mechanisms can be recycled and be reused.

Below, further description of the present invention will be made in conjunction with the drawings and the embodiments.

In embodiments of the present invention, the firing mechanism is a firing pin and ammunition or explosive is gunpowder, for example.

EMBODIMENT 1

Figure 1:
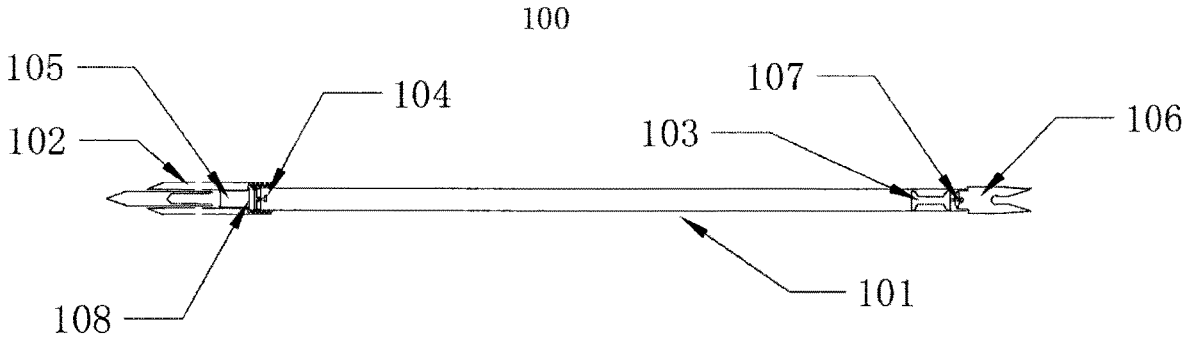
FIG. 1 shows an arrow device with dual destructive function according to one embodiment of the present invention.

FIG. 1 shows an arrow device with dual destructive function 100 according to an embodiment of the present invention. The arrow device with dual destructive function 100 includes an arrow body 101 and an arrowhead 102. An inertial body 103 is movable in a hollow tube of the arrow body 101 which transfers kinetic energy to the inertial body 103 and achieves kinetic energy so as to move forward. According to a principle of physics, the arrow body 101 drastically decelerates or stops when encountering resistance, but the inertial body 103 which is independent from the arrow body 101 continues to move forward at a speed due to inertia and strikes a firing pin 104. The struck firing pin 104 then strikes a primer 108 which is located in front of the firing pin 104 and ignites gunpowder 105 so as to push the arrowhead 102 outwardly. As shown in FIG. 1, the firing pin 104 is located at a center position of the arrow body 101 near the arrowhead 102 and the inertial body 103 is connected to the arrow body 101 near a rock 106 through a limit mechanism 107.

EMBODIMENT 2

Figure 2A:
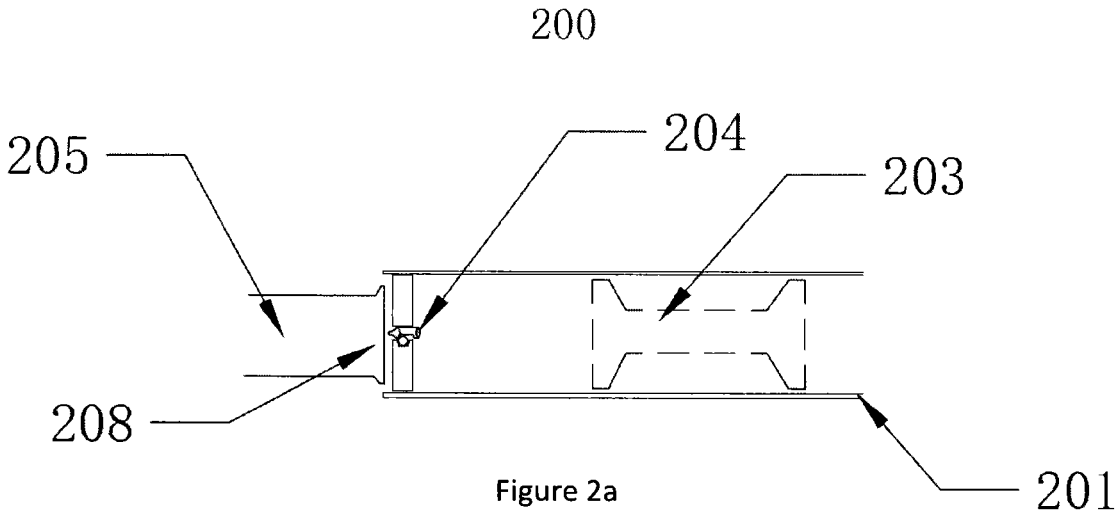
FIG. 2*a* shows a state in which the arrow device with dual destructive function is to be initiated.
Figure 2B:
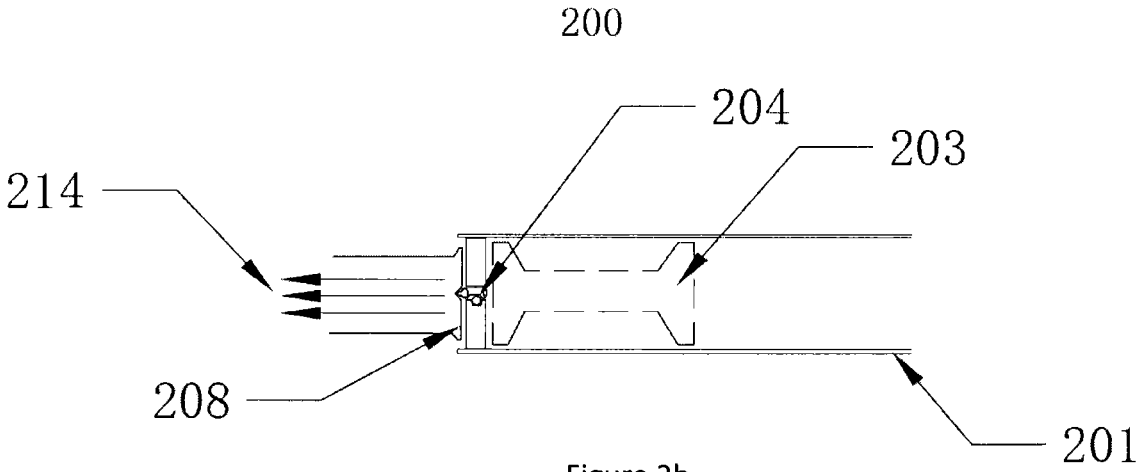
FIG. 2*b* shows a state in which the arrow device with dual destructive function has been initiated.

FIG. 2 shows an embodiment in which a primer of ammunition is located at a center when the firing is performed, that is to say, shows an arrow device with dual destructive function 200 in which a firing portion is located in a center of a cross section of an arrow body 201. FIG. 2*a* shows a state in which the arrow device with dual destructive function is to be initiated, and FIG. 2*b* shows a state in which the arrow device with dual destructive function has been initiated. An inertial body 203 directly strikes a firing pin 204 which then strikes a primer 208 in front of the firing pin 204. The primer 208 ignites gunpowder 205. In FIG. 2*b*, high temperature and pressure gas generated by gunpowder 205 is denoted by a reference number 214.

EMBODIMENT 3

Figure 3A:
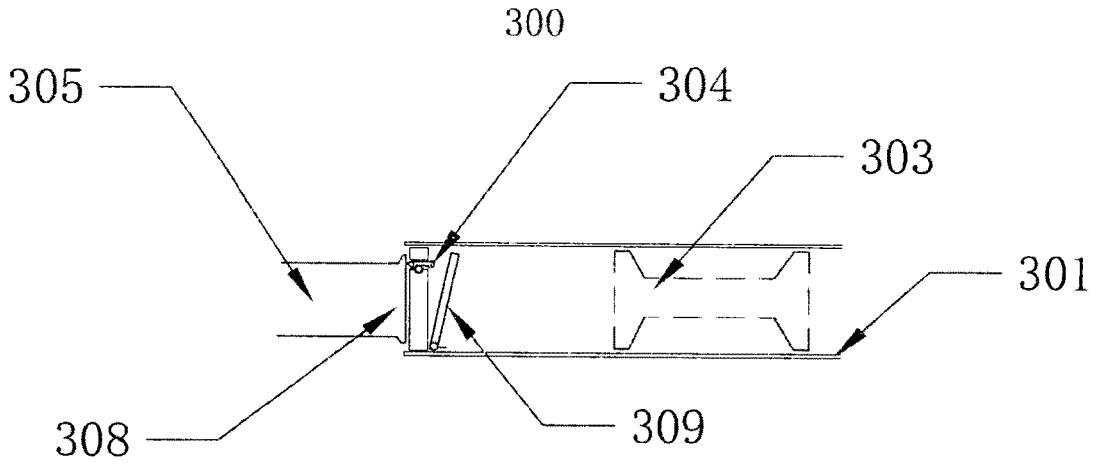
FIG. 3*a* shows a state in which the arrow device with dual destructive function is to be initiated.
Figure 3B:
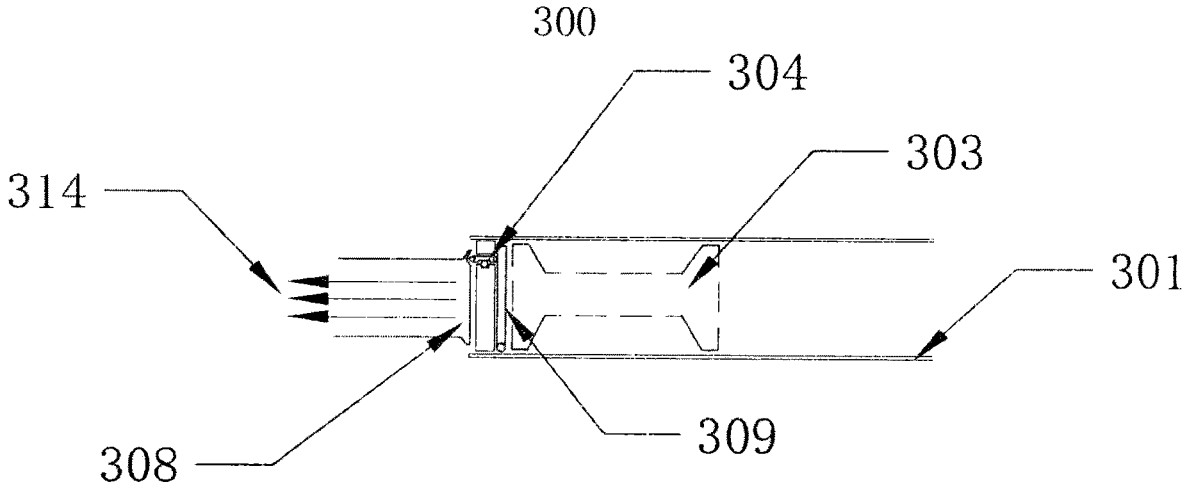
FIG. 3*b* shows a state in which the arrow device with dual destructive function has been initiated.

FIG. 3 shows an embodiment in which a primer of ammunition is located at an edge when the firing is performed, that is to say, shows an arrow device with dual destructive function 300 in which a firing portion is located between a center and a periphery of a cross section of an arrow body 301. FIG. 3*a* shows a state in which the arrow device with dual destructive function is to be initiated, and FIG. 3*b* shows a state in which the arrow device with dual destructive function has been initiated. A uniform force mechanism 309 is provided between an inertial body 303 and a firing pin 304. As shown in FIG. 3, if the firing pin 304 is located a non-center position in an arrow body 301 near an arrowhead (for example, the primer is ammunition fired at an edge), the inertial body 303 will indirectly strikes the firing pin 304 by striking the uniform force mechanism 309 (such as baffles or shafts). The firing pin 304 then strikes a primer 308 which ignites gunpowder 305 so as to perform explosion within a target. In FIG. 3*b*, high temperature and pressure gas generated by gunpowder 305 is denoted by a reference number 314.

EMBODIMENT 4

Figure 4A:
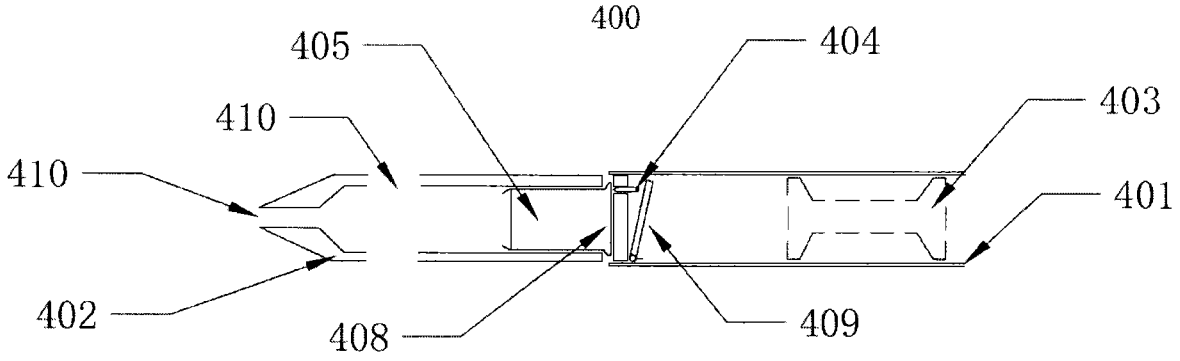
FIG. 4*a* shows a state in which the arrow device with dual destructive function is to be initiated.
Figure 4B:
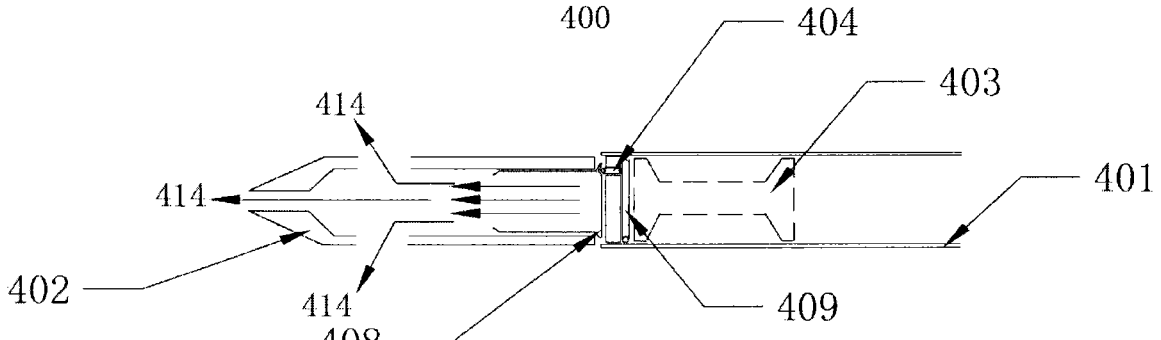
FIG. 4*b* shows a state in which the arrow device with dual destructive function has been initiated.

FIG. 4 shows an arrow device with dual destructive function 400 in which gunpowder 405 is blank ammunition. FIG. 4*a* shows a state in which the arrow device with dual destructive function is to be initiated, and FIG. 4*b* shows a state in which the arrow device with dual destructive function has been initiated. As shown in FIG. 4, an arrowhead 402 is provided with a high temperature and pressure gas outlet 410 via which high temperature and pressure gas 414 is blown (injected) out after explosion of gunpowder 405 so as to apply the second destruction to the target in addition to a penetrative destruction. Further, the arrow device with dual destructive function 400 comprises an arrow body 401, an inertial body 403, a firing pin 404, a primer 408 and a uniform force mechanism 409.

EMBODIMENT 5

FIG. 5 shows an arrow device with dual destructive function 500 in which an arrowhead comprises a closed housing, wherein FIG. 5*a* shows a state in which the arrow device with dual destructive function is to be initiated, and FIG. 5*b* shows a state in which the arrow device with dual destructive function has been initiated. The closed housing 513 is located in front of an arrow body 501. An inertial body 503 indirectly strikes a firing pin 504 by striking a uniform force mechanism 509. The firing pin 504 then strikes a primer 508 which ignites gunpowder 505. In FIG. 5*b*, high temperature and pressure gas denoted by a reference number 514 and generated by explosion of gunpowder 505 may blow open the closed housing 513.

EMBODIMENT 6

FIG. 6 shows an arrow device with dual destructive function 600 in which an object to be fired is provided at the arrowhead, wherein FIG. 6*a* shows a state in which the arrow device with dual destructive function is to be initiated, and FIG. 6*b* shows a state in which the arrow device with dual destructive function has been initiated. The object to be fired is disposed at an arrowhead 602. When an inertial body 603 within an arrow body 601 strikes a uniform force mechanism 609, the uniform force mechanism 609 will fire a firing pin 604 by transfer of force. Then, a primer 608 is ignited so as to fire gunpowder 605. Then, the object to be fired 612 is propelled. As shown in FIG. 6*a*, a high temperature and pressure gas outlet 610 is provided at the arrowhead 602. Also, as shown in FIG. 6*b*, high temperature and pressure gas is denoted by a reference number 614.

EXAMPLE 7

FIG. 7 shows another arrow device with dual destructive function 700 in which the object to be fired is provided at the arrowhead. An object to be fired 712 is designed with a hollow cavity at a bottom and the hollow cavity is connected to an arrowhead 702. High temperature and pressure gas denoted by a reference number 714 and generated by explosion of gunpowder 605 and incompletely burnt gunpowder rush into the hollow cavity of the object to be fired 712 and push the object to be fired 712 forward again. Further, the arrow device with dual destructive function 700 comprises an arrow body 701, an inertial body 703, a firing pin 704, a primer 708 and a uniform force mechanism 709.

It shall be noted that in addition to the embodiments described above, there are other embodiments of the present invention. Obviously, relevant and equivalent technical solutions should fall within the scope of the invention.

The invention claimed is:

1. An arrow device with dual destructive function, comprising:

an arrow body comprising a hollow tube that is provided with an inertial body therein;

an arrowhead of a hollow structure including a first end coupled to the arrow body, a second end opposite the first end, and body section extending between the first end and the second end and including a sidewall, the body section being provided with a hole structure in the sidewall that communicates the hollow structure of the arrowhead with the outside and acting as high temperature and pressure gas outlets, the hollow structure of the arrowhead being equipped with explosives or ammunition therein;

an isolation mechanism is provided between the arrowhead and the hollow tube of the arrow body; and a firing mechanism for firing the explosives or the ammunition is provided on the isolation mechanism or a front end of the inertial body.

2. The arrow device with dual destructive function according to claim 1, wherein the firing mechanism on the isolation mechanism or the front end of the inertial body is a firing pin or a firing hammer.

3. The arrow device with dual destructive function according to claim 2, wherein a firing portion of the firing mechanism is located at a center of a cross-section of the arrow body, or the firing portion of the firing mechanism is located between the center and a periphery of the cross-section of the arrow body, and a uniform force mechanism is provided between the inertial body and the firing mechanism.

4. The arrow device with dual destructive function according to claim 2, wherein said inertial body is spherical, conical, cylindrical, or dumbbell-shaped.

5. The arrow device with dual destructive function according to claim 2, wherein a housing of the arrowhead has a prefabricated scrap thereon.

6. The arrow device with dual destructive function according to claim 2, wherein an object to be fired is provided at the arrowhead.

7. The arrow device with dual destructive function according to claim 6, wherein the object to be fired has a hollow cavity at a bottom thereof.

8. The arrow device with dual destructive function according to claim 1, wherein said inertial body is spherical, conical, cylindrical, or dumbbell-shaped.

9. The arrow device with dual destructive function according to claim 1, wherein a housing of the arrowhead has a prefabricated scrap thereon.

10. The arrow device with dual destructive function according to claim 1, wherein an explosive airflow causes explosion of a housing of the arrowhead.

11. The arrow device with dual destructive function according to claim 10, wherein an object to be fired has a hollow cavity at a bottom thereof.

12. The arrow device with dual destructive function according to claim 1, wherein the inertial body is weakly connected to a rear end of the hollow tube of the arrow body prior to firing and strikes forward along the hollow tube of the arrow body when a strike occurs so as to initiate the ammunition or the explosives.

13. The arrow device with dual destructive function according to claim 12, wherein the rear end of the hollow tube of the arrow body is provided with an elastic mechanism which is connected to the inertial body is weakly connected to the inertial body prior to firing.

14. The arrow device with dual destructive function according to claim 1, wherein a rear end of the hollow tube of the arrow body is provided with an elastic mechanism which is connected to the inertial body is weakly connected to the inertial body prior to firing.

15. The arrow device with dual destructive function according to claim 1, wherein the hole structure communicating the hollow structure of the arrowhead with the outside comprises a plurality of holes.

16. An arrow device, comprising:

an arrow body comprising a hollow tube that includes an inertial body therein;

an arrowhead of a hollow structure including a hole structure communicating the hollow structure of the arrowhead with the outside, the hollow structure of the arrowhead being equipped with explosives or ammunition therein;

an isolation mechanism provided between the arrowhead and the hollow tube of the arrow body;

a firing mechanism for firing the explosives or the ammunition provided on the isolation mechanism or a front end of the inertial body wherein a firing portion of the firing mechanism is located at a center of a cross-section of the arrow body, or the firing portion of the firing mechanism is located between the center and a periphery of the cross-section of the arrow body; and a uniform force mechanism is provided between the inertial body and the firing mechanism.

17. An arrow device, comprising:

an arrow body comprising a hollow tube that includes an inertial body therein;

an arrowhead of a hollow structure including a plurality of holes communicating the hollow structure of the arrowhead with the outside, the hollow structure of the arrowhead being equipped with explosives or ammunition therein;

an isolation mechanism provided between the arrowhead and the hollow tube of the arrow body; and a firing mechanism for firing the explosives or the ammunition provided on the isolation mechanism or a front end of the inertial body.

* * * * *